US006290524B1

(12) United States Patent
Simmel

(10) Patent No.: US 6,290,524 B1
(45) Date of Patent: Sep. 18, 2001

(54) SYSTEM FOR VARYING CAPACITIVE COUPLING BETWEEN ELECTRICAL TERMINALS

(75) Inventor: George M. Simmel, Naperville, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/614,787

(22) Filed: Jul. 12, 2000

(51) Int. Cl.[7] ..... H01R 13/28
(52) U.S. Cl. ..... 439/289; 439/941
(58) Field of Search ..... 439/607, 608, 439/609, 941, 289

(56) References Cited

U.S. PATENT DOCUMENTS

| | | | | |
|---|---|---|---|---|
| 4,268,102 | | 5/1981 | Grabbe . | |
| 4,341,433 | | 7/1982 | Cherian et al. . | |
| 4,828,503 | | 5/1989 | Gilissen et al. | 439/62 |
| 4,906,194 | | 3/1990 | Grabbe | 439/71 |
| 4,995,817 | | 2/1991 | Grabbe | 439/71 |
| 4,998,886 | | 3/1991 | Werner | 439/66 |
| 5,152,694 | | 10/1992 | Bargain | 439/66 |
| 5,308,252 | | 5/1994 | Mroczkowski et al. | 439/66 |
| 5,540,599 | | 7/1996 | Bishop | 439/289 |
| 5,547,405 | * | 8/1996 | Pinney et al. | 439/894 |
| 5,601,447 | * | 2/1997 | Reed et al. | 439/404 |
| 5,762,516 | * | 6/1998 | Itoga et al. | 439/404 |
| 5,772,449 | | 6/1998 | Feldmeier et al. | 439/66 |
| 6,007,368 | * | 12/1999 | Lorenz et al. | 439/418 |
| 6,017,240 | * | 1/2000 | Belopolsky et al. | 439/418 |
| 6,017,247 | * | 1/2000 | Gwiazdowski | 439/676 |
| 6,019,639 | * | 2/2000 | Brunker et al. | 439/637 |
| 6,113,418 | * | 9/2000 | Kjeldahl | 439/405 |
| 6,120,329 | * | 9/2000 | Steinman | 439/676 |

* cited by examiner

*Primary Examiner*—Neil Abrams
(74) *Attorney, Agent, or Firm*—Stephen Z. Weiss

(57) ABSTRACT

A system is provided for varying the capacitive coupling between adjacent terminals in an electrical connector. A connector housing includes at least a pair of adjacent terminal-receiving passages. At least a pair of terminals are insertable into the passages. Each terminal includes a contact end and a terminating end. A pair of generally parallel, laterally spaced arms extend in a given direction between the contact and terminating ends. One end of one of the arms is joined to the contact end, and one end of the other of the arms is joined to the terminating end. An irregularly shaped portion joins the ends of opposite end of the arms. Therefore, the pair of terminals can be inserted into the passages as mirror images of each other to maximize capacitive coupling between the terminals. Alternatively, the pair of terminals alternately can be inserted into the passages inverted relative to each other to transversely misalign the irregularly shaped portions and, thereby, reduce the capacitive coupling between the terminals.

15 Claims, 3 Drawing Sheets

SYSTEM FOR VARYING CAPACITIVE COUPLING BETWEEN ELECTRICAL TERMINALS

FIELD OF THE INVENTION

This invention generally relates to the art of electrical connectors and, particularly, to a system for varying the capacitive coupling between adjacent terminals in an electrical connector.

BACKGROUND OF THE INVENTION

In some applications, electrical connectors generally require liberal performance tolerances and manufacturing tolerances to allow for the abusive conditions under which they are used. The terminals within such connectors must be physically long to allow a relatively large deflection range without degrading the long-term performance and properties of the terminal connections. A consequence of increased length is higher inductance and, since the terminals typically are mounted in parallel within a conductor, they may be prone to capacitive coupling when high-speed signals are transmitted by adjacent terminals. High capacitive coupling creates "cross-talk" between terminals of different differential pairs, which is one of the main reasons for electronic signal degradation.

In order to solve these problems, counter-measures have been taken, such as miniaturizing the connector components including the terminals. However, this complicates the associated tooling and assembly processes. Additional electronic devices can be added to "filter" the cross-talk or noise that has been introduced into the electrical signals. However, this significantly increases the costs of the connector. In some instances, selective pairing of terminals in a differential pair allows the characteristics of the original signal to be re-constructed. However, most connector designs cannot provide for a large variety of paired and de-coupled terminal combinations.

The present invention is directed to solving the myriad of problems described above by a unique terminal configuration in which the terminals are relatively long; the terminals providing maximum flexibility; the orientation of the terminals in pairs thereof being easily varied; and no additional costs being involved in tooling or assembly to achieve the design's flexibility.

SUMMARY OF THE INVENTION

An object, therefore, of the invention is to provide a new and improved system for varying the capacitive coupling between adjacent terminals in an electrical connector.

In the exemplary embodiment of the invention, an electrical connector includes a dielectric housing having at least a pair of adjacent terminal-receiving passages. At least a pair of terminals are insertable into the passages. Each terminal includes a contact end, a terminating end and a pair of generally parallel, laterally spaced arms extending in a given direction between the contact and terminating ends. One end of one of the arms is joined to the contact end, and one end of the other arm is joined to the terminating end. An irregularly shaped portion joins the ends of the arms opposite said one ends. Therefore, the pair of terminals can be inserted into the passages as mirror images of each other to maximize capacitive coupling between the terminals with the entire surface of each of the pair of terminals overlapping one another. Alternatively, the pair of terminals can be inserted into the passages inverted relative to each other to transversely misalign the irregularly shaped portions and, thereby, reduce the capacitive coupling between the terminals with only portions of the surface of each of the pair of terminals overlapping one another. As disclosed herein, the irregularly shaped portions of the terminals are S-shaped.

According to one aspect of the invention, each of the terminals includes a base portion extending transversely of the arms of the terminal and to which the one end of said other of the arms is joined. The terminating end of the terminal comprises a tail portion extending from the base portion. The base portion is elongated sufficiently to provide plural locations from which the tail portion can extend therefrom. The contact end of the terminal comprises a contact blade.

In the preferred embodiment, the pair of arms of the pair of terminals substantially overlap each other transversely of the arms when the terminals are inverted relative to each other. As disclosed herein, a plurality of pairs of the terminal-receiving passages are provided in the connector housing for receiving a corresponding plurality of pairs of the terminals. Therefore, at least one pair of terminals can be oriented as mirror images of each other, and at least one other pair of terminals can be oriented as inverted relative to each other. Consequently, those two pairs will have a differential capacitive coupling.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
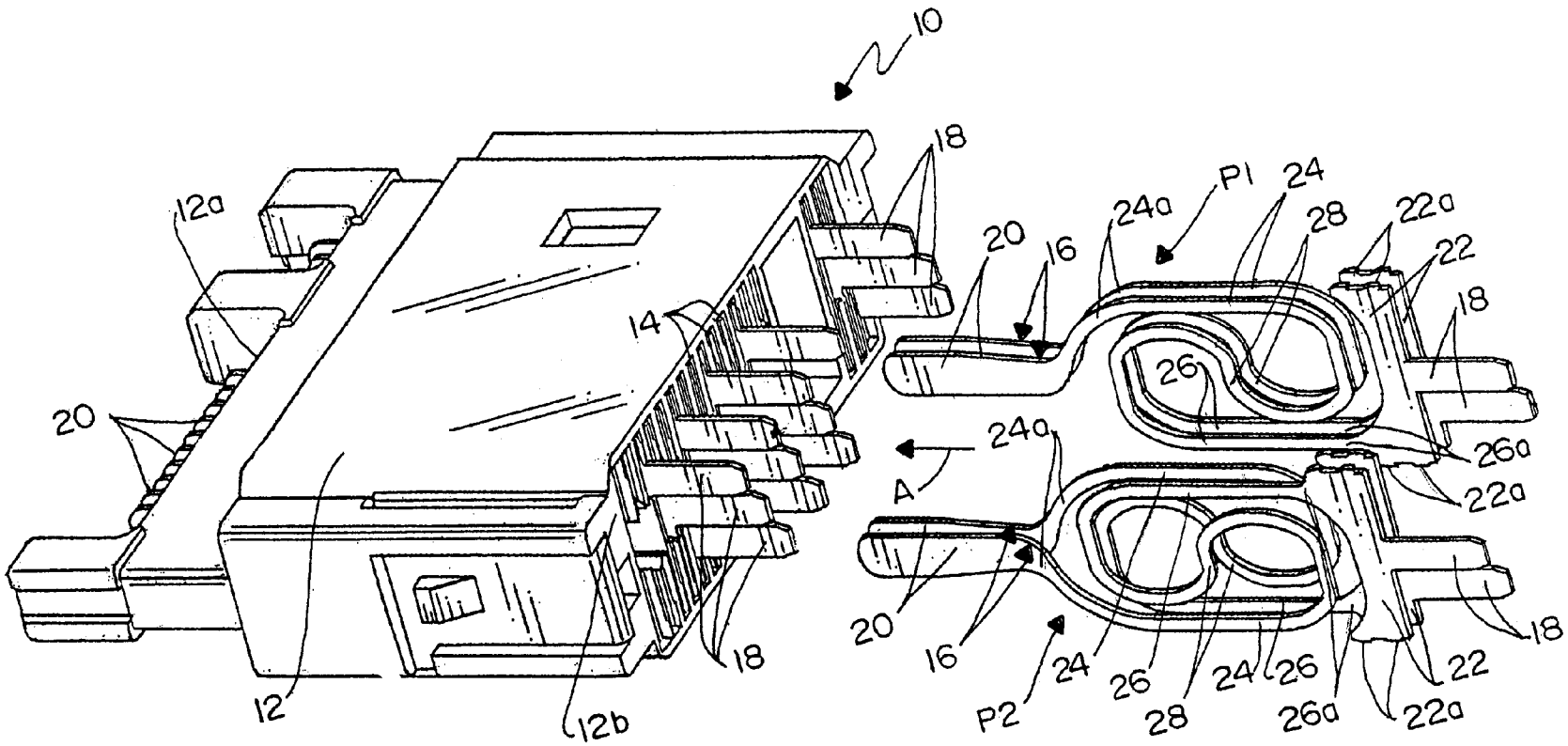
FIG. 1 is a perspective view of an electrical connector embodying the concepts of the invention, with two pairs of terminals removed from the connector housing. Each pair of terminals has a different relative orientation to the other terminal in the pair.

Referring to the drawings in greater detail, and first to FIG. 1, the invention is embodied in an electrical connector, generally designated 10, which includes a dielectric housing 12 such as of molded plastic material. The housing has a front or mating end 12*a* and a rear or terminating end 12*b*. The housing has a plurality of side-by-side terminal-receiving passages 14 extending between mating end 12*a* and terminating end 12*b*.

A plurality of terminals, generally designated 16, are inserted into terminal-receiving passages 14 of connector housing 12 in the direction of arrow "A" (FIG. 1) through terminating end 12*b* of the housing. At this point, it should be understood that each terminal 16 is stamped from conductive sheet metal material in an identical configuration except for the location of a terminating end or tail portion 18.

The location of the tail portion is determined by the orientation of the respective terminal in its respective passage 14, as well as the particular passage in which a terminal is inserted. For instance, as seen in FIG. 1, it can be seen that a plurality of tail portions 18 project rearwardly of terminating end 12*b* of connector housing 12. The tail portions can be seen to be in three different vertical orientations. The tail portions may be soldered to conductors of an electrical cable, and it would be difficult to perform such connecting operations if all of the tail portions were immediately adjacent each other side-by-side along terminating end 12*b* of the connector housing. Therefore, the terminals will be considered hereinafter as being substantially identically configured, except for the particular location of tail portions 18.

With that understanding, each terminal 16 includes a front contact end or blade 20 and a rear terminating end formed by a base portion 22 and rearwardly projecting tail portion 18. It can be seen that contact blades 20 project forwardly of mating end 12*a* of the connector housing through locating slots (not shown) for connection to appropriate contacts or terminals of a complementary mating connector (not shown). Base portions 22 are elongated transversely of the insertion direction "A" and have teeth 22*a* stamped at opposite edges thereof for skiving into the plastic material of housing 12 at opposite ends of passages 14 to secure the terminals in the passages.

Figure 2:
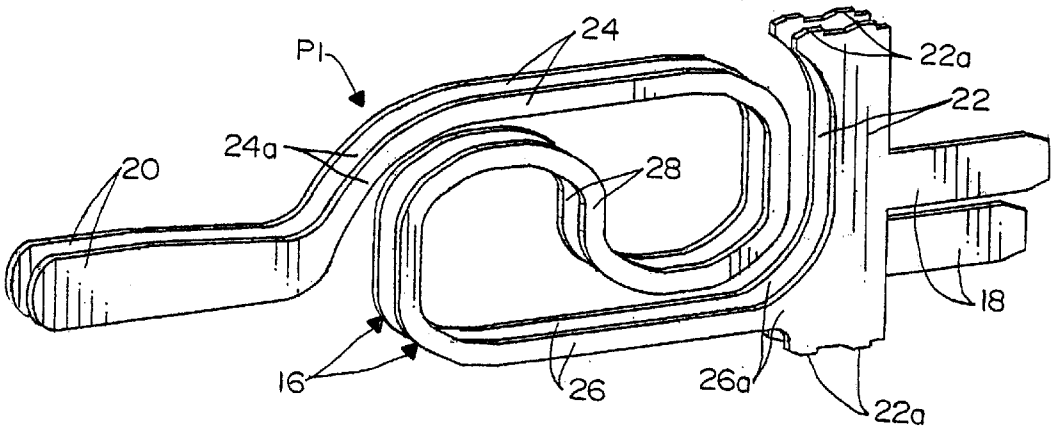
FIGS. 2 and 3 are isolated perspective views of the two removed pairs of terminals shown in FIG. 1.
Figure 3:
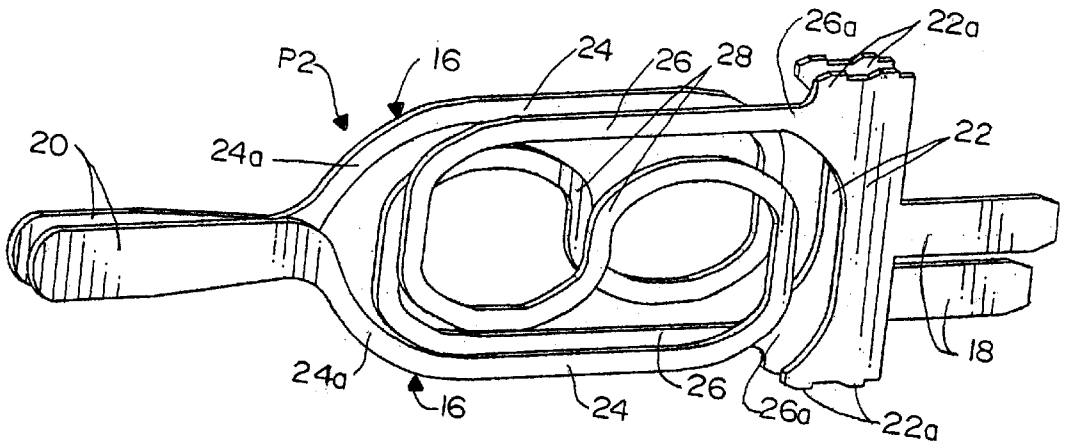

Referring to the enlarged depictions of FIGS. 2 and 3 in conjunction with FIG. 1, each terminal 16 includes a pair of generally parallel, laterally spaced arms 24 and 26 extending in direction "A" between contact blade 20 and base portion 22 of the terminal. One end 24*a* of arm 24 is joined to contact blade 20. One end 26*a* of arm 26 is joined to base portion 22. The opposite ends of the arms are joined by an irregularly shaped portion 28 of the terminal. In the preferred embodiment of the invention, irregularly shaped portion 28 of each terminal is S-shaped in configuration to provide considerable resiliency between the opposite ends of the terminals. In addition, arms 24 and 26 and S-shaped portion 28 provide a considerably "long" terminal or current path between the contact and terminating ends of the terminal.

FIG. 1 shows two pairs of terminals, generally designated P1 and P2. Enlarged FIG. 2 shows pair P1, and enlarged FIG. 3 shows pair P2. It can be seen in FIG. 2 that terminals 16 in pair P1 are arranged as mirror images of each other, except for tail portions 18. In other words, the terminals are inserted into passages 14 of connector housing 12 in the same orientation. It can be seen in FIG. 3 that terminals 16 of pair P2 have been inverted relative to each other so that only contact blades 20, base portions 22 and arms 24 and 26 overlap each other. S-shaped portions 28 of pair P2 are misaligned from each other.

Figure 4:
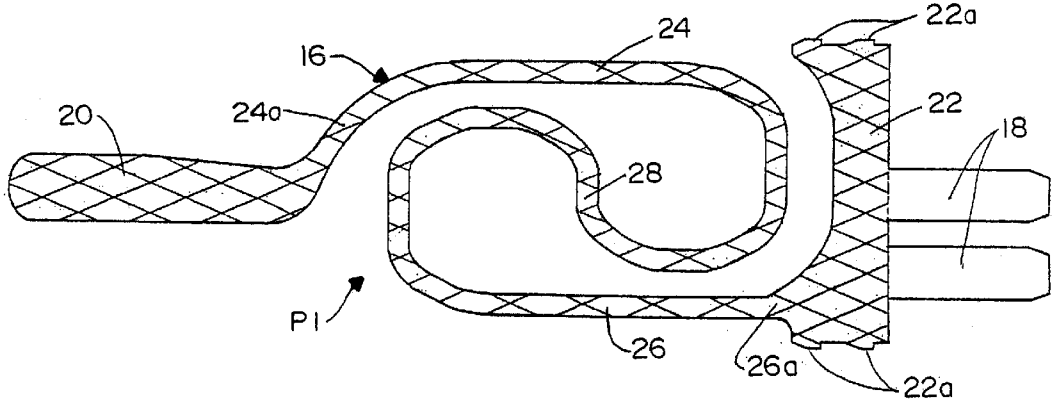
FIGS. 4 and 5 are side elevational views of the two pairs of terminals shown in FIGS. 2 and 3, respectively, showing shaded areas of overlap between the terminals in each pair.
Figure 5:
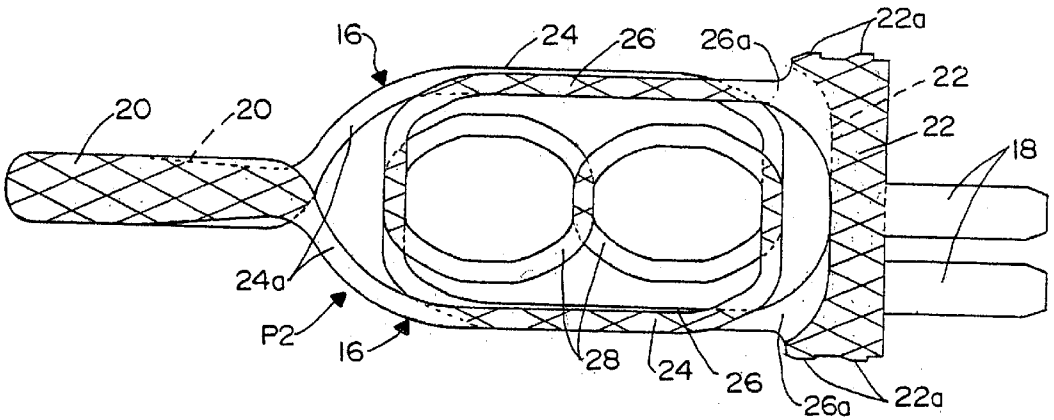

FIGS. 4 and 5 (in conjunction with FIGS. 2 and 3, respectively) illustrate the differential in capacitive coupling between pair P1 (FIG. 4) of terminals 16 and pair P2 (FIG. 5) of the terminals 16. In particular, capacitive coupling is largely determined by the amount of area juxtaposition between a pair of conductors, such as terminals 16. It can be seen in FIGS. 2 and 4 that terminals 16 in pair P1 are oriented as mirror images of each other. In other words, all of the components, including contact blade 20, base portion 22, arms 24 and 26 and S-shaped portion 28 of the terminals are in precise alignment. Therefore, in FIG. 4, all of these components are shaded to show the amount of area juxtaposition between the terminals in pair P1. Obviously, the overlapping areas are substantially total and, therefore, capacitive coupling is at a maximum between the terminals of pair P1.

Comparing the above description of the P1 pair of terminals in FIGS. 2 and 4, reference now is made to the orientation of the terminals in pair P2 in FIGS. 3 and 5. It can seen that the terminals in pair P2 have been inverted relative to each other. Looking at the shaded areas in FIG. 5, it can be seen that contact blades 20 and base portions 22 of the terminals substantially overlap. Inverted arms 24 and 26 overlap to some degree but not totally. S-shaped portions 28 of the two terminals have very little overlapping areas. Therefore, comparing the overlapping areas of the terminals in FIG. 5 with the substantial overlapping of the terminals in FIG. 4, it can be understood that the capacitive coupling between the inverted terminals in FIG. 5 is significantly less than that of the completely overlapping terminals in FIG. 4.

Referring back to FIG. 1, it can be understood that different pairs of terminals 16, such as pairs P1 and P2, can be mounted in terminal-receiving passages 14 of connector housing 12 as desired to meet particular specifications of the connector. By changing the capacitance of individual pairs, the current characteristics of the pairs can be matched to different combinations of pairs of conductors of an electrical cable, for instance. Within a differential pair of terminals, where increased capacitive coupling is desired, the pair of differential terminals can be arranged as in pair P1. Between two pairs of differential pairs of terminals, where reduced capacitive coupling is desired, the adjacent terminals can be arranged as in pair P2.

With the opposite arms 24, 26 extending in the same direction, having approximately the same length and with the irregularly shaped portion 28 being symmetrical about a line extending between end 24*a* and 26*a*, the contact end 20 will tend to move toward and away from the base terminal end 22 with little or no lateral or twisting movement. This will reduce the possibility of the contact end 20 from binding against the walls of the locating slot, in the mating end 12*a* of the housing, within which the contact end 22 reciprocates.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A system for varying the capacitive coupling between the adjacent terminals in an electrical connector, comprising:

a dielectric housing having at least a pair of adjacent terminal-receiving passages; and at least a pair of terminals insertable into said passages, each terminal including a contact end, a terminating end, a pair of generally parallel laterally spaced arms extending in a given direction between said ends, one end of one of said arms being joined to said contact end, one end of the other of said arms being joined to said terminating end, and an S-shaped portion joining the ends of said arms opposite said one ends, whereby the pair of terminals can be inserted into the passages as mirror images of each other transversely of said given direction to maximize capacitive coupling between the terminals, and the pair of terminals alternately can be inserted into the passages inverted relative to each other to transversely misalign said S-shaped portions and, thereby, reduce the capacitive coupling between the terminals.

2. The system of claim 1 wherein the terminating end of each of said terminals includes a base portion extending transversely of said given direction and to which said one end of the other of said arms is joined.

3. The system of claim 2 wherein said terminating end comprises a tail portion extending from the base portion.

4. The system of claim 3 wherein said base portion is elongated sufficiently to provide plural locations from which the tail portion can extend.

5. The system of claim 1 wherein said contact end of each terminal comprises a contact blade.

6. The system of claim 1 wherein said pair of arms of the pair of terminals substantially overlap each other transversely of said given direction when the terminals are inverted relative to each other.

7. The system of claim 1, including a plurality of pairs of said terminal-receiving passages for receiving a corresponding plurality of pairs of said terminals, whereby at least one pair of terminals can be oriented as mirror images of each other and at least one other pair of terminals can be oriented as inverted relative to each other.

8. A system for varying the capacitive coupling between the adjacent terminals in an electrical connector, comprising:

a dielectric housing having at least a pair of adjacent terminal-receiving passages; and at least a pair of terminals insertable into said passages, each terminal including a contact end, a terminating end, a pair of generally parallel laterally spaced arms extending in a given direction between said ends, one end of one of said arms being joined to said contact end, one end of the other of said arms being joined to said terminating end, an irregularly shaped portion joining the ends of said arms opposite said one ends, and the terminating end having a centerline extending in the given direction, each arm located an equal distance from said centerline, the contact end extending in said given direction parallel to the centerline and the irregularly shaped portion being symmetrical about a line beginning at said one end of said one arm and ending at said one end of said other arm so that the contact end moves along said centerline, whereby the pair of terminals can be inserted into the passages as mirror images of each other transversely of said given direction to maximize capacitive coupling between the terminals, and the pair of terminals alternately can be inserted into the passages inverted relative to each other to transversely misalign said irregularly shaped portions and, thereby, reduce the capacitive coupling between the terminals.

9. The system of claim 8 wherein the terminating end of each of said terminals includes abase portion extending transversely of said given direction and to which said one end of the other of said arms is joined.

10. The system of claim 9 wherein said terminating end comprises a tail portion extending from the base portion.

11. The system of claim 10 wherein said base portion is elongated sufficiently to provide plural locations from which the tail portion can extend.

12. The system of claim 8 wherein said contact end of each terminal comprises a contact blade.

13. The system of claim 8 wherein said pair of arms of the pair of terminals substantially overlap each other transversely of said given direction when the terminals are inverted relative to each other.

14. The system of claim 8, including a plurality of pairs of said terminal receiving passages for receiving a corresponding plurality of pairs of said terminals, whereby at least one pair of terminals can be oriented as mirror images of each other and at least one other pair of terminals can be oriented as inverted relative to each other.

15. The system of claim 8, wherein the pair of arms are generally the same length.

* * * * *